United States Patent [19]

Ohta et al.

[11] Patent Number: 4,707,999

[45] Date of Patent: Nov. 24, 1987

[54] RECEIVER FOR REFRIGERANT APPARATUS

[75] Inventors: Hiromi Ohta, Kariya; Shinji Ogawa, Aichi; Yosiharu Kajikawa, Hekinan; Keiichi Fukumura, Kariya; Kiyomitsu Tsuchiya, Okazaki; Kiyoshi Kittaka, Nukata; Katsushi Narita, Nishio, all of Japan

[73] Assignee: Nippondenso Co., Ltd., Kariya, Japan

[21] Appl. No.: 831,792

[22] Filed: Feb. 21, 1986

[30] Foreign Application Priority Data

| | | | |
|---|---|---|---|
| Feb. 25, 1985 | [JP] | Japan | 60-35943 |
| Apr. 22, 1985 | [JP] | Japan | 60-59929[U] |
| May 30, 1985 | [JP] | Japan | 60-81120[U] |
| Sep. 20, 1985 | [JP] | Japan | 60-144560[U] |

[51] Int. Cl.[4] ..... F25B 43/00

[52] U.S. Cl. ..... 62/474; 62/509

[58] Field of Search ..... 62/474, 509

[56] References Cited

U.S. PATENT DOCUMENTS

| | | | |
|---|---|---|---|
| 2,335,694 | 11/1943 | Paquin et al. | 62/509 X |
| 3,545,227 | 12/1970 | Grahl | 62/474 |
| 3,759,062 | 9/1973 | Wrenn et al. | 62/474 |
| 3,785,164 | 1/1974 | Wrenn, Jr. | 62/509 X |
| 3,838,578 | 10/1974 | Sakasegawa et al. | 62/474 X |
| 4,072,615 | 2/1978 | McConnell | 62/474 X |

FOREIGN PATENT DOCUMENTS 59-189068 12/1984 Japan .

*Primary Examiner*—Lloyd L. King

*Attorney, Agent, or Firm*—Cushman, Darby & Cushman

[57] ABSTRACT

A receiver has a good usage for receiving coolant in a refrigerant circuit. The receiver can improve the fixing and the connecting operation when the receiver is connected with the refrigerant circuit provided in an automotive engine room. The receiver is comprised of a receiver housing having a flat upper surface and a couple of block joints having a flat lower surface. The block joints are furnished on the upper surface of the receiver housing by screwing. The block joints have connecting halls an inlet and an outlet pipes are jointed therein. At least one of the connecting halls are formed vertically so that at least one of the inlet and the outlet pipes elongates upwardly. Therefore, the inlet or the outlet pipe has advantage to be connected easily and effectively.

13 Claims, 45 Drawing Figures

RECEIVER FOR REFRIGERANT APPARATUS

FIELD OF THE INVENTION

This invention relates to a receiver which receives coolant temporarily, the receiver of this invention being used in a refrigerant circuit.

BACKGROUND OF THE INVENTION

Conventionally, an inlet pipe and an outlet pipe are connected to a receiver housing in such manner that both pipes are connected directly to the receiver housing then fixed to each other as shown in Japanese Utility Model Laid-Open publication (KOKAI) 59-189068. These conventional receivers have the disadvantage that the operation of connecting both pipes to each other and to the receiver housing is too complicated.

SUMMARY OF THE INVENTION

The object of this invention is to simplify the operation of connecting the inlet and the outlet pipes.

Another object of this invention is to provide a receiver which can vary the angle between the inlet pipe and the outlet pipe.

Still other object of this invention is to automate the furnishing operation of elements on the block joint.

Another object of this invention is to reduce the capital cost of the receiver.

A further object of this invention is to provide a receiver to which can be connected elements such as a pressure switch and a sight glass.

Another object of this invention is to reduce the production cost by using a forging press. A bottom portion of the receiver housing is formed by the forging press.

A further object of this invention is to increase the strength of the receiver housing.

A still further object of this invention is to reduce the product cost of a block joint which is connected at the top portion of the receiver housing.

Another object of this invention is to form a thickened portion in a top portion of the receiver housing.

In order to attain objects the present invention employs a receiver housing the top portion of which is flat, a block joint connected on the upper surface of the top portion, and an inlet and an outlet pipe detachably connected with the block joint. At least one of pipes elongates upwardly.

The receiver of this invention has the inlet and the outlet pipes functionally connected at the top portion of the receiver housing.

The top portion and a wall portion of the receiver housing are formed integrally, and a bottom plate is fixed with the receiver housing in order to close the bottom opening portion. The bottom plate has a supporting flange around the edge thereof in order to increase the strength of the receiver housing.

The block joint of this invention has an opening at one surface thereof and a protruding portion at the opposite surface thereof. The opening of the block joint opens upwardly in order to connect the pipe. The protruding portion of the block joint elongates downwardly so that the protruding portion is inserted into the connecting opening which is made at the top portion of the receiver housing.

DETAILED DESCRIPTION OF THE INVENTION

Figure 1:
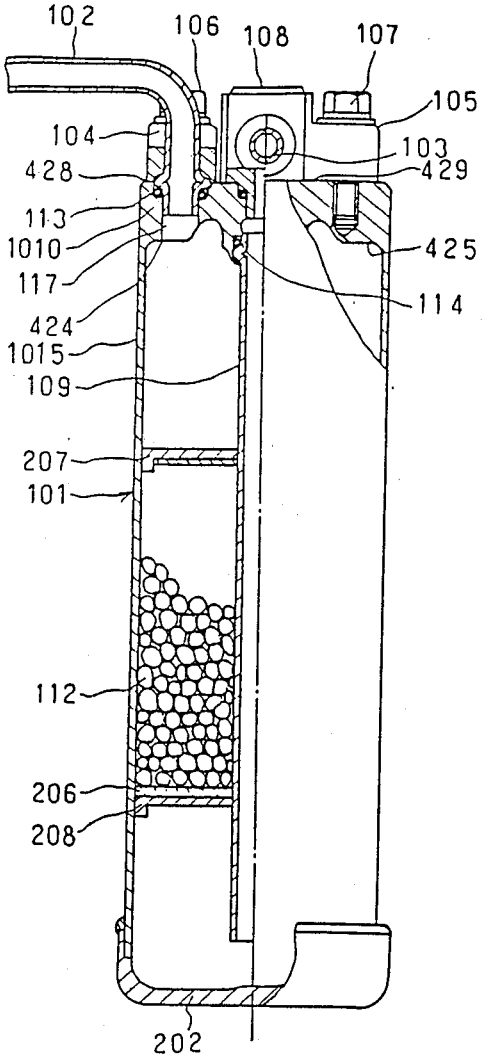
FIG. 1 is an elevational view, partly in section of a receiver embodying this invention.
Figure 2:
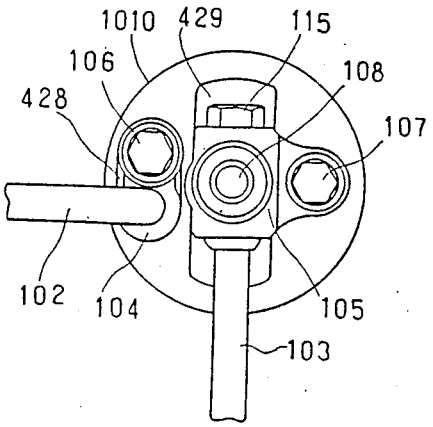
FIG. 2 is a top view of the receiver shown in FIG. 1.

FIGS. 1 and 2 show the first embodiment of the receiver which is used in an automotive refrigerant circuit. Numeral 101 shows a cylindrical receiver housing made of aluminum, which stocks coolant of the refrigerant circuit temporarily. The receiver housing is comprised of a top portion 1010, side wall 1015 integral therewith and a cap-like bottom portion 202 which is connected to the bottom edge of the side wall 1015 by welding. Numeral 102 shows an inlet pipe through which the coolant flows. Numeral 103 shows an outlet pipe through which the coolant flows. Both pipes 102 and 103 are made of copper or aluminum. Numerals 104 and 105 show block joints made of aluminum to which the pipes 103 and 102 respectively are connected. Numerals 106 and 107 show bolts which fasten the block joints 104 and 105 to the top portion 1010. Numeral 108 shows a sight glass connected with the block joint 105. Numeral 109 shows a tube depending from an aperture in the top portion 1010 to near the bottom portion 202. The coolant in the housing 101 flows toward the outlet pipe 103 through the tube 109. Numerals 207 and 208 show partition plates having a number of small apertures in order to pass the coolant therethrough. Dryer 112 is supported between the plates 207 and 208 which are fixed to the inner surface of the wall portion 1015. The dryer 112 sandwiched between the plates 207 and 208 via felt 206 removes humidity from the coolant. Numeral 114 shows an O-ring which seals the tube 109 and to the top portion 1010. Numeral 115 shows a melting bolt screwed into the block joint 105 opposite the pipe 103 and having a small passage therethrough which is plugged by a low metal (melting point is 100°–110° C.), so that the coolant in the housing can escape to the atmosphere through the bolt 115 when the temperature of the coolant becomes higher than the melting point of the low melting point metal.

Figure 3:
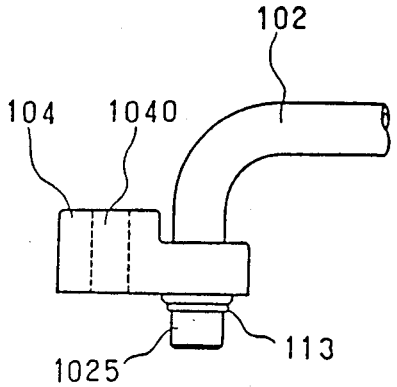
FIG. 3 is a front view of one the block joints shown in FIG. 1.
Figure 4:
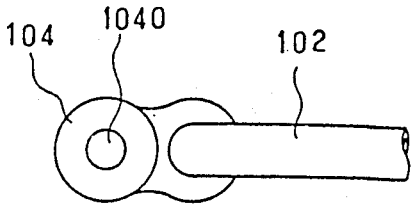
FIG. 4 is a top view of the block joint shown in FIG. 3.
Figure 5:
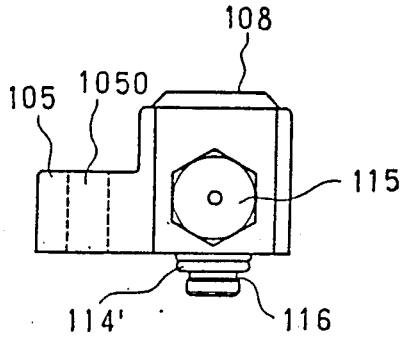
FIG. 5 is a front view of the other block joint shown in FIG. 1.
Figure 6:
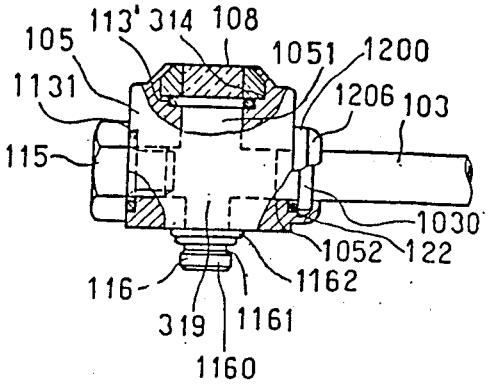
FIG. 6 is a partly sectional side view of the block joint shown in FIG. 5.

The pipe 102 connected with the block joint 104 is shown in FIGS. 3 and 4. Numeral 1040 shows the connecting hole in which bolt 106 is inserted. FIGS. 5 and 6 show the bolt 115 and a protruding integral connecting portion 116 which is inserted into the opening in the top portion 1010 from which the tube 109 depends. The interior path portion 1051 of the block joint is cross-shaped and the outer ends thereof include the bolt 115, connecting portion 116, sight glass 108 and the pipe 103.

A recess 314 at which the sight glass 108 is fixed by calking is provided at the upper surface of the block joint 105. An O-ring 113' is inserted between the sight glass 108 and a side of the recess 314.

The connecting portion 116 is formed in the block joint 105 opposite the sight glass 108. The outer diameter of the connecting portion 116 varies. The portion 1162 adjacent the block joint 104 has the largest diameter; then the outer diameter is smaller to about the half length of the connecting portion 116; then the outer diameter becomes larger again so that an annular recess 1161 is formed. An O-ring 114' is provided on the recessed portion 1161.

An O-ring 1131 is inserted between the block joint 104 and the head of bolt 115.

Figure 8:
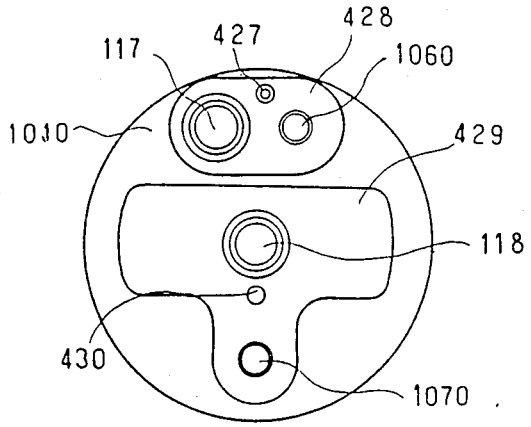
FIG. 8 is a top view of the receiver housing shown in FIG. 7, FIGS. 9 and 10 are sectional views of a modification of the block joint shown in FIG. 5, FIGS. 11–16 are top views of the receiver corresponding to FIG. 2, showing variations of the angle between the pipes.
Figure 7:
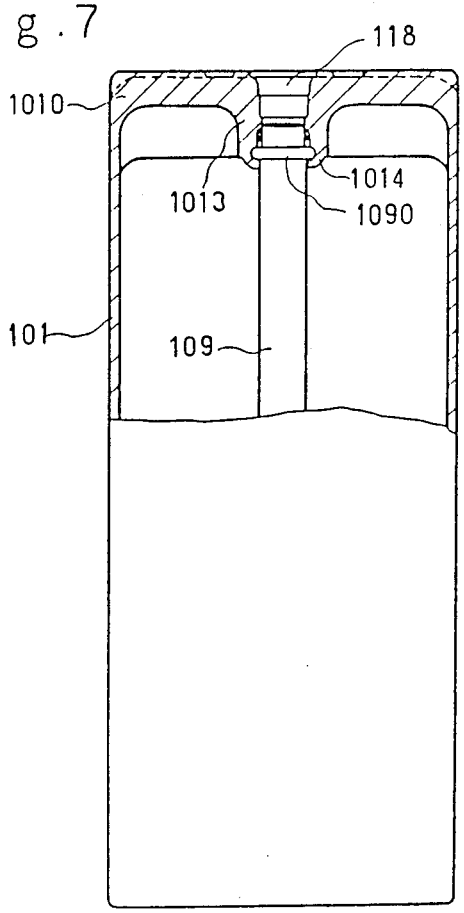
FIG. 7 is a partly sectional side view of the receiver housing shown in FIG. 1.

As shown in FIGS. 7 and 8 the upper surface of the top portion 1010 of the receiver has plane parts 428 and 429 on which the block joints 104 and 105 are mounted. The oval plane part 428 has a through aperture 117 in which the inlet pipe 102 is inserted, a pilot recess 427 by which the position of the block joint 104 is decided and a screw socket 1060 into which fixing bolt 106 of the block joint 104 is screwed. The T-shaped plant part 429 has a through aperture 118 in which the connecting portion 116 is inserted, a pilot recess 340 by which the position of the block joint 105 is decided and a screw socket 1070 in which fixing bolt 107 of the block joint 105 is screwed.

Figure 9:
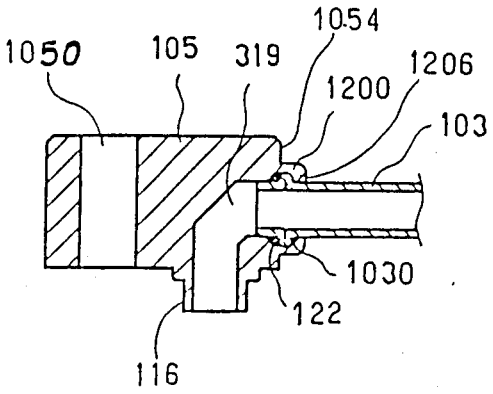
Figure 10:
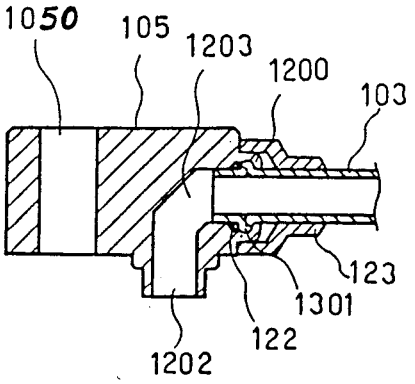
Figure 11:
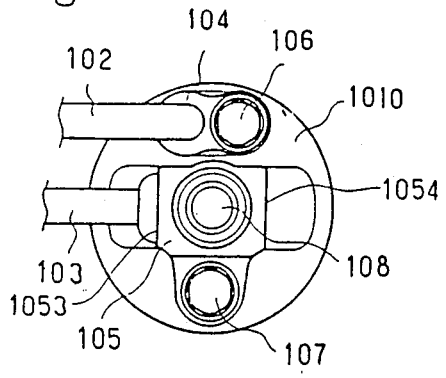
Figure 12:
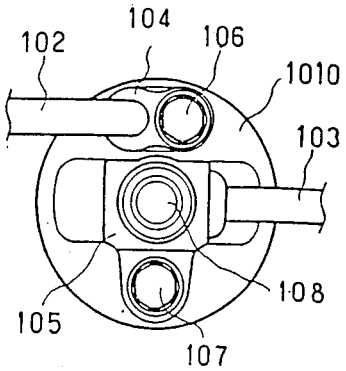
Figure 13:
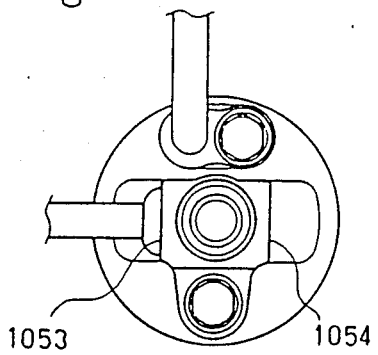
Figure 14:
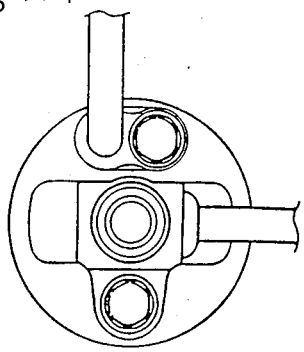
Figure 15:
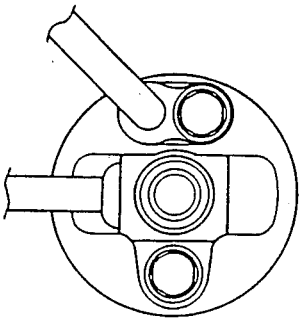
Figure 16:
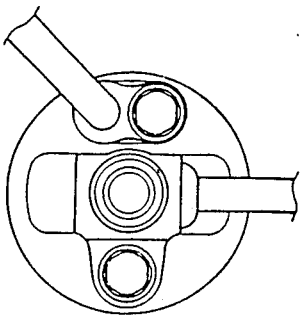

Numeral 1013 shows a connecting mouth provided at the under surface of the top portion 1010. The edge 1014 of the mouth 1013 is calked toward an annular convex portion of the tube 109 so that the tube 109 is fixed to the housing 101. The inlet and outlet pipes 102 and 103 also are connected with the block joint 105 by the calking. FIG. 9 shows one embodiment of calking and FIG. 10 shows another embodiment of calking. In FIG. 9 numeral 1200 shows a connector which is formed at the side wall of the block joint 105 and is bent inwardly against an annular convex portion 1030 of the inlet pipe 103. Numeral 122 shows an O-ring provided between the annular convex portion 1030 and the block joint 105. Numeral 1050 shows a through hole through which the fixing bolt 107 of the block joint 105 is inserted. Numeral 319 shows a connecting passage provided within the block joint 105 and inter connecting the inlet pipe 103 and the connecting portion 116. In FIG. 10 numeral 123 shows a sleeve 123 which reinforces the fixing strength of the inlet pipe 103.

Figure 18:
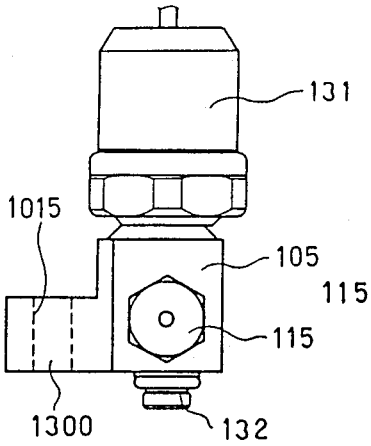
FIG. 18 is a front view of the block joint shown in FIG. 17.
Figure 17:
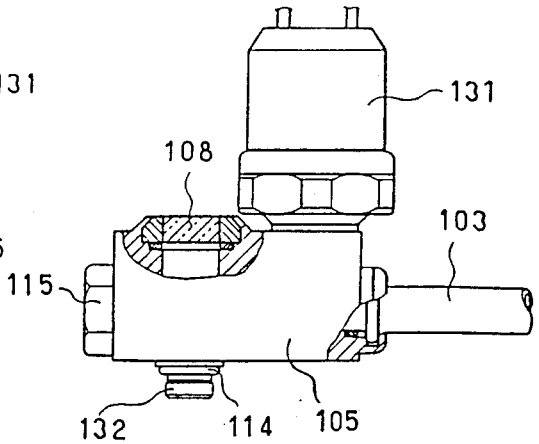
FIG. 17 is a side view, partly in section of the block joint shown in FIG. 6.
Figure 20:
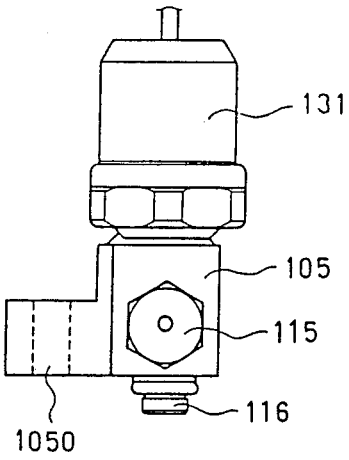
FIG. 20 is a front view of the block joint shown in FIG. 19.
Figure 19:
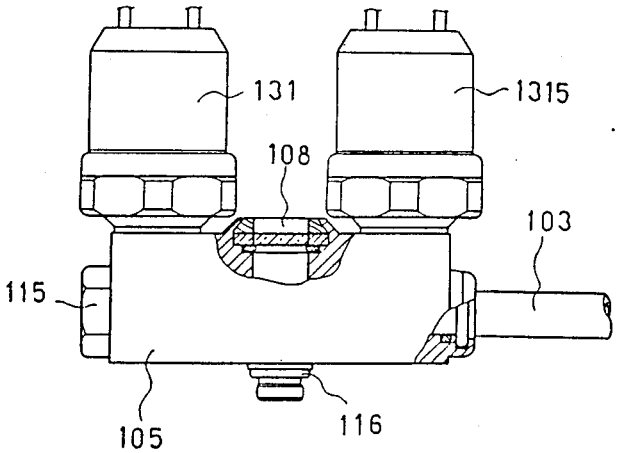
FIG. 19 is a side view of another modification of the block joint shown in FIG. 6.
Figure 22:
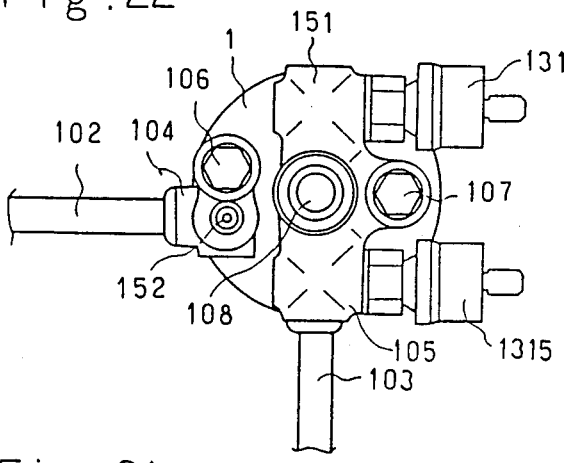
FIG. 22 is a top view of the receiver shown in FIG. 21.
Figure 21:
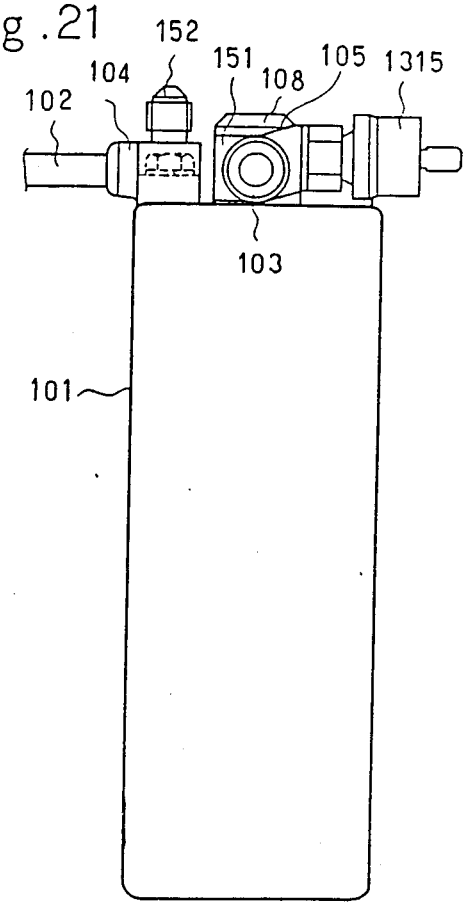
FIG. 21 is a front view of the receiver equipped with the block joint shown in FIG. 19.
Figure 24:
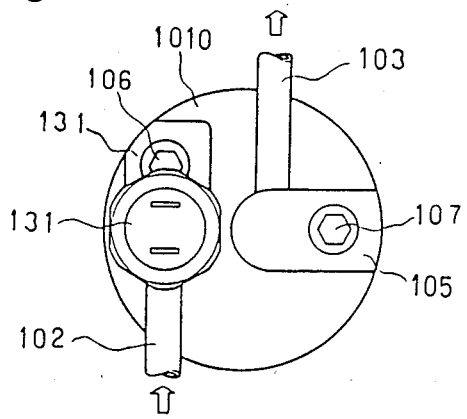
FIG. 24 is a top view of the receiver shown in FIG. 23.
Figure 23:
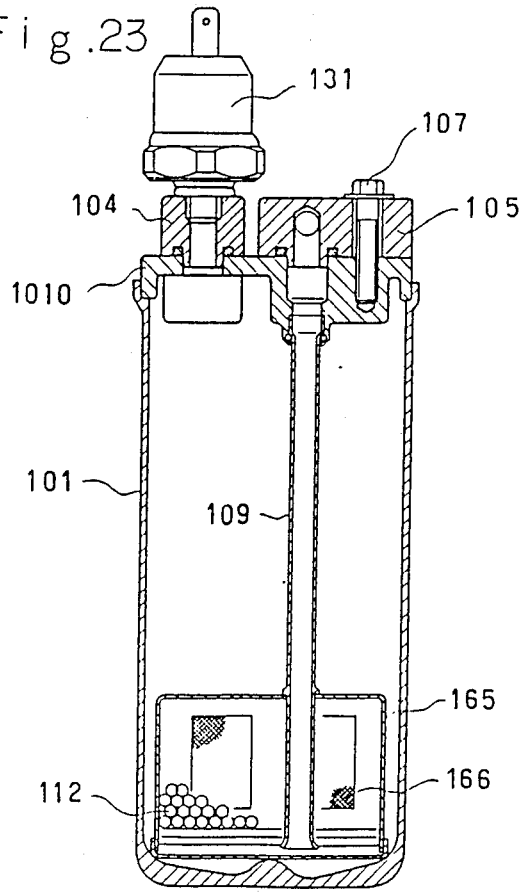
FIG. 23 is a sectional view of a receiver with another modification of the block joints.

The angle between the inlet pipe 102 and the outlet pipe 103 can be varied freely as shown in FIGS. 11–16. Another functional element, such as a pressure switch 131, can be connected on a modified block joint 105 as shown in FIGS. 17 and 18. FIGS. 19 and 20 show another embodiment which has two pressure switches 131 and 1315 on the block joint 105. FIGS. 21 and 22 show a receiver which employs the block joint 104 and the block joint 105 shown in FIGS. 19 and 20. The receiver having the block joints 104 and 105 on which the pressure switch 131 is mounted is shown in FIGS. 23 and 24. Numeral 165 shows for a container a dryer, 112 having a window 166 covered by mesh.

Figure 26:
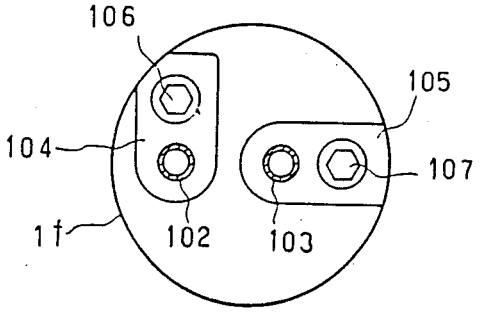
FIG. 26 is a top view of the receiver shown in FIG. 25.
Figure 25:
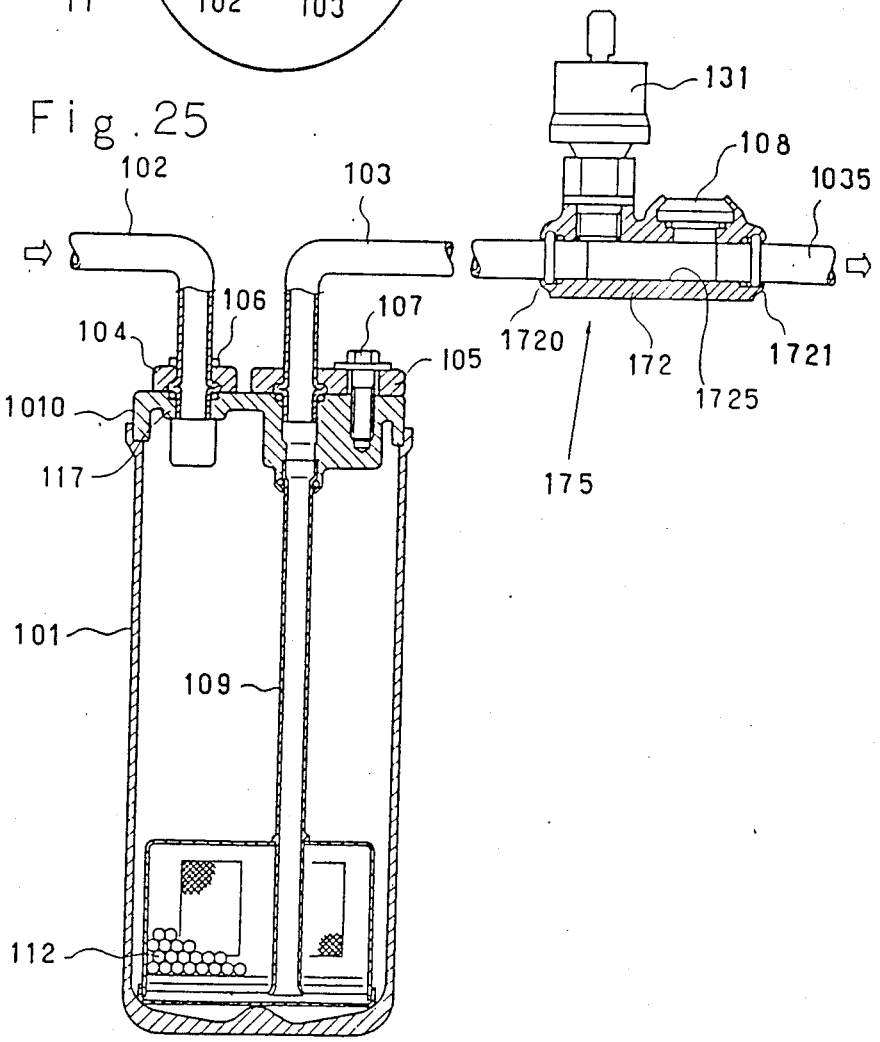
FIG. 25 is a sectional view of a receiver with further modifications of the block joints.

The functional accessory elements such as the sight glass 108 and the pressure switch 131, can be located otherwise than on the block joints 104 and 105. FIGS. 25 and 26 show an embodiment in which such elements 108 and 131 are provided on the outlet pipe 103. Numeral 172 shows a connecting base provided on the extension 1035 of the outlet pipe 103. The sight glass 108 and the pressure switch 131 are mounted on the connecting base 172.

Figure 28:
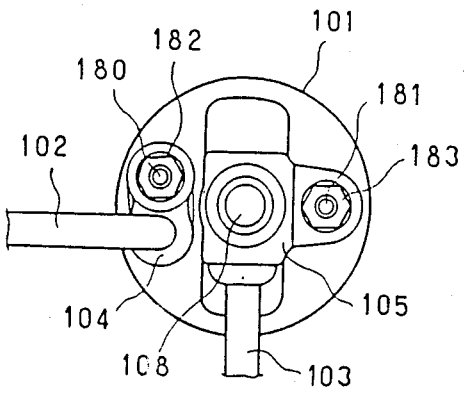
FIG. 28 is a top view of the receiver shown in FIG. 27.
Figure 27:
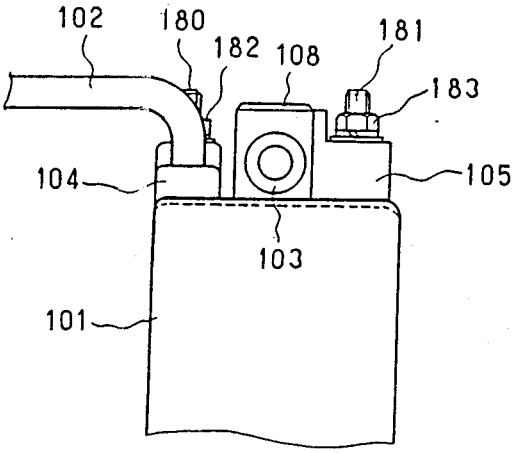
FIG. 27 is a front view of a receiver with still further modifications of the block joints.

There is another variation for connecting the block joints 104 and 105 and the receiver housing 101. As shown in FIGS. 27 and 28, it is preferred to furnish fixing bolts on they extend through the through holes 1040 and 1050 of the block joints 104 and 105. The block joints 104 and 105 are fixed by lock nuts 182 and 183 on the bolts 180 and 181.

Figure 29:
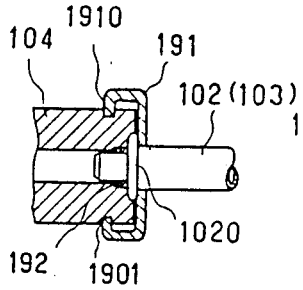
FIG. 29 is a sectional view of a portion of a block joint.
Figure 30:
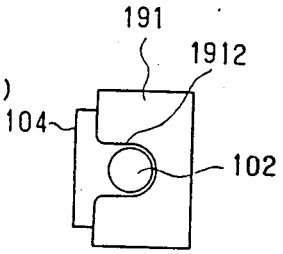
FIG. 30 is a side view of a portion of the block joint shown in FIG. 29.

The inlet and the outlet pipes 102 and 103 can be fixed with the block joints 104 and 105 without calking. As shown in FIGS. 29 and 30, a clamping element 191 can be used in order to fix the inlet pipe 102 onto the block joint 104. Numeral 1901 shows a clamping groove in which the edge 1910 of the clamping element 191 is inserted. The clamping element 191 has a slot 1912 in which the inlet or the outlet pipe 102 or 103 is received. The edge of the receiving slot 1912 engages the annular convex portion 1020 of the inlet pipe 102 and forces the annular convex portion 1020 leftwardly as shown in FIG. 29 so that the O-ring 192 is deformed when the edge 1910 of the clamping element 191 is inserted in the groove 1901.

Figure 31:
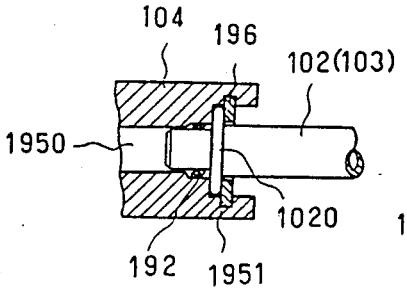
FIG. 31 is a sectional view of a portion of a modification of the block joint.
Figure 32:
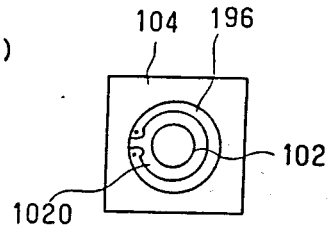
FIG. 32 is a side view of a portion of the block joint shown in FIG. 31.

FIGS. 31 and 32 show another species in which a circular clip 196 is used instead of the clamping element 191. The outer edge of the circular clip 196 is inserted into an annular groove 1951 provided in the block joint 104.

The functional advantages of the receiver described above are explained hereinafter.

The top portion 1010 of the receiver housing 101 is formed with the plane portions 428 and 429, as shown in FIGS. 8 and 9 and the block joints 104 and 105 mounted thereon. The end 1025 of the inlet pipe 102 having an L-shaped end portion is inserted into a through hall of the block joint 104 in such a manner that the inlet pipe 102 elongates vertically for a short distance, as shown in FIG. 3. The end 1025 of the inlet pipe 102 protrudes below the lower surface of the block joint 104 and is inserted into the connecting passage 117 provided in the top portion 1010 of the receiver housing 101. The bolt 106 is screwed into the screw socket 1060 formed in the top portion 1010 incompletely so that the bolt 106 holds the block joint 104 in such manner that it can move slightly. After that, the inlet pipe 102 is set the preferred position by rotating the horizontal portion thereof. After modulating the angle of the inlet pipe 102, the bolt 106 is screwed completely tight in order to fix the position of both the inlet pipe 102 and the block joint 104.

On the other hand, since the connecting hole 1052 of the block joint 105 in which the outlet pipe is fixed is formed horizontally, the straight outlet pipe 103 should extend horizontally. The connecting hole 1052 for the outlet pipe 103 is functionally interconnected to the connecting portion 116 for the tube 109 through the pass portion 1051. The connecting portion 116 is inserted into the hole 118 formed in the top portion 1010. The bolt 107 is screwed into the screw socket 1070 formed in the top portion so as to sandwich the block joint 105. After screwing the bolt 107 tightly, the outlet pipe 103 is connected with the receiver housing 101 completely.

The outlet pipe 103 is fixed with the block joint 105 air tight, because there is sandwiched the O-ring 122 between the block joint 105 and the annular convex portion 1030 of the outlet pipe 103. The calking edge 1206 of the connector 1200 is calked inwardly in order to fixed the outlet pipe 103 and also in order to deform the O-ring 122, as shown in FIG. 9. The sleeve 123 (as shown in FIG. 10) reinforces both the calking strength of the calking edge 1206 and the sealing efficiency of the O-ring 122.

The inlet pipe 102 is also fixed with the block joint 104 air tight. Since the O-ring 113 is put on a shoulder 1176 formed in the through hole 117 of the top portion 1010, the O-ring 113 is sandwiched between the shoulder 1176 and the annular convex portion 1020 of the inlet pipe 102 when the inlet pipe 102 is inserted into the hole 117. The O-ring 113 is deformed when the bolt 106 is screwed into the screw socket 1060 of the top portion 1010 completely and seals between the top portion 1010 and the inlet pipe 102. In other words, the effective air tightness between the receiver housing 101 and the inlet pipe 102 can be attained only by tightening the bolt 106. Accordingly, the fixing operation can be done easily even if the receiver is located in an automotive engine room and does not have enough space around there.

As described above, the angle between the inlet and the outlet pipes 102 and 103 can be varied. FIGS. 11–16 show this effect. Since the opposite side walls 1053 and 1054, on which the connector 1200 for connecting the outlet pipe 103 are formed is made symmetrically, the outlet pipe 103 can be connected with the block joint 105 from either the right side or the left side as in FIGS. 11–16.

The functional elements located on the block joint 105, such as the sight glass 131, and the pressure switch 108 do not have enough anti-heat strength. However, since the receiver of this embodiment does not need any heat for connecting the receiver housing 101 and the block joints 104 and 105, such elements 108 and 131 can be provided directly on the block joint. In other words, such elements 108 and 131 can be fixed on the block joint 105 before the block joint 105 is connected with the receiver housing 101.

It is required for the inlet and the outlet pipes 102 and 103 to be varied in shape in order to adapt to any variation of the automotive engine room. The block joints 104 and 105 and the elements 108 and 131, on the other hand, are not necessary to be varied. Therefore, the elements 108 and 131 can be connected with the block joint 105 in the factory. Namely, the block joint 105, the sight glass 108 and the pressure switch 131 can be assembled to make one assembly.

The elements 108 and 131 also can be assembled independently of the receiver, as shown in FIG. 25. Numeral 175 shows the functional unit comprising the connecting base 172, the pressure switch 131 and the sight glass 108. The connecting base 172 has the through hole 1725 through which the coolant flows. A calking portion 1720 is formed at one end of the through hole 1725, so that the end portion of the outlet pipe 103 can be fixed with the connecting base 172 by calking. Another calking portion 1721 is also provided at the other end portion of the through hole 1725 for connecting a pipe 1035. Since both the inlet and the outlet pipes 102 and 103 have L-shaped end portion, the angle between the horizontal portions of the inlet and the outlet pipes 102 and 103 can be varied more freely.

It is required to be flat at the connecting portion of the top portion 1010 in order to fix the block joints 104 and 105 thereon by screwing the bolts 106 and 107. Therefore, the top portion of the above embodiment has the plane portions 428 and 429. It should be noted that the top portion 1010 does not have to be flat throughout whole upper surface thereof. Only the special portions on which the block joints 104 and 105 is furnished should be flat.

Figure 33:
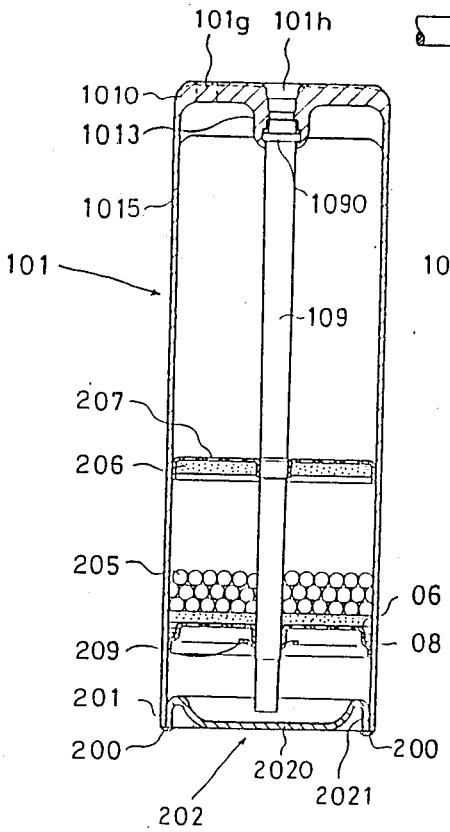
FIG. 33 is a sectional view of a modification of the receiver housing.

FIG. 33 shows other embodiment of this invention where the receiver housing 101, the side wall portion 1015 and the top portion 1010 are made integrally by a forging press. Namely, both the portions 1015 and 1010 are made of aluminum alloy. Numeral 202 shows a bottom plate made from aluminum alloy plate and formed by stamping. The bottom plate 202 has a flange portion 1021 around its edge in order to reinforce its strength. The bottom plate 202 and the bottom edge of the wall portion 1015 are welded each other, as at 200. Numeral 205 shows a dryer which removes humidity from the coolant. Numeral 206 shows a felt plate provided at the both upper and lower sides of the dryer 205. Numerals 107 and 208 show a punched plate for holding the felt plate 206. The punched plate 208 is fixed by a holding nut 209 which is fixed on the tube 109.

Figure 34:
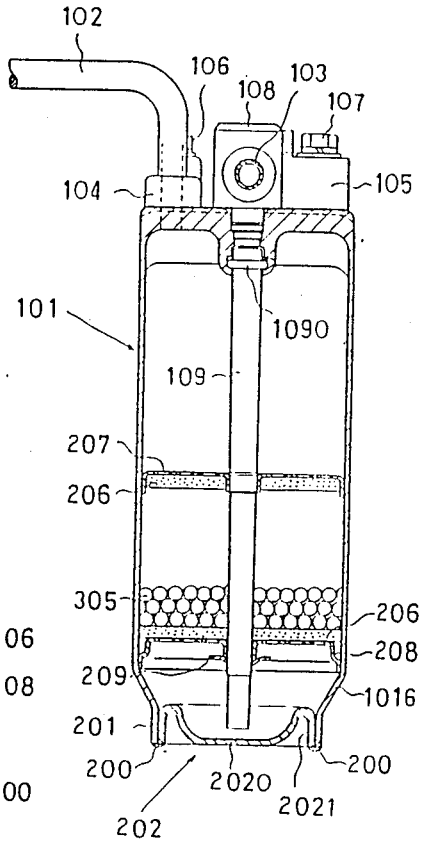
FIG. 34 is a sectional view of another modification of the receiver.

FIG. 34 shows still other embodiment of the receiver of this invention. The diameter of the receiver housing 101 is reduced at the lower portion 1016 of the side wall portion 1015 so that the outer diameter of the bottom plate 202 is also reduced.

The embodiments shows in FIGS. 33 and 34 have the special advantages described as follows:

Since the bottom plate 202 is made from metal plate and formed only by stamping, the production cost of the bottom plate 202 can be reduced. Though the bottom plate 202 is made from thin metal plate, it has enough strength, because it has the reinforcing flange portion 2021 around its edge. It is required for the receiver housing 101 to have enough strength because the pressure of the coolant in the receiver housing 101 may become very high when high temperature coolant is introduced thereinto. Therefore, the bottom plate 202 must also have enough strength. Since the outer diameter of the bottom plate 202 of FIG. 34 is reduced, the pressure force on the bottom plate 202 is also reduced. Therefore, the bottom plate 202 of FIG. 34 can maintain sufficient strength even if its thickness of which is reduced.

The thickness of the top portion 1010 is also reduced as shown in FIGS. 33 and 34, because the top portion itself does not serve as a connector for the pipes 102 and 103. The top portion 1010 serves as a connecting base for the block joints 104 and 105 to which the pipes 102 and 103 are connected.

Figure 35:
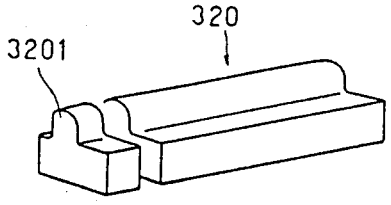
FIG. 35 is a perspective view of a material from which a block joint is made.

The block joint 105 is provided by the steps shown in FIGS. 35–39. FIG. 35 shows the first step for cutting a block joint material 3201. Numeral 320 shows an aluminum material which has about the same outer shape of that of the block joint 105. The block joint material 3201 is cut from the aluminum material 320 with a predetermined width.

Figure 36:
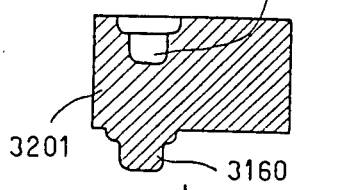
FIG. 36 is a sectional view of the material shown in FIG. 35.
Figure 37:
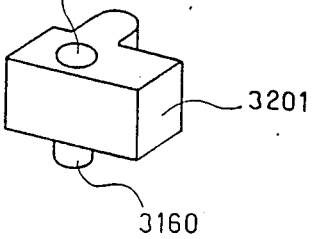
FIG. 37 is a perspective view of a material shown in FIG. 36.

FIGS. 36 and 37 show a second step for a forging press. A preliminary hole 3140 which will be the recess 314 for the sight glass 108 then is made in the upper surface of the block joint material 3201 by the forging press. The preliminary protruding portion 3610 which will be the connecting portion 116 then is formed at the lower surface of the block joint material 3201 by the forging press simultaneously. Therefore, the axis of the preliminary hole 3140 and that of the preliminary protruding portion 3160 locate on approximately same line. Since the preliminary hole 3140 and the preliminary protrusion 3160 are made by the same pressing, the outer diameter of the preliminary protruding portion 3160 is slightly larger than the inner diameter of the preliminary hole 3140.

Figure 38:
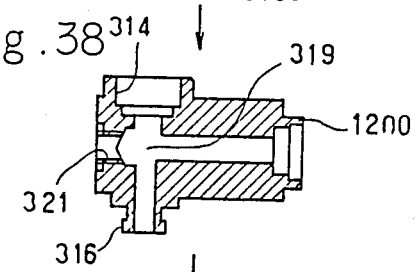
FIG. 38 is a sectional view of a block joint made from the material shown in FIG. 36.

FIG. 38 shows the third step for fining. Burr formed during the first and second steps of cutting and pressing is removed in order to fine the shape of the screw hole 321 for receiving the bolt 315, the connecting portion 1200 for holding the pipe 103, the connecting portion 316 for attaching the block joint 104 onto the housing 101, and the connecting passage 319 interconnecting these parts 321, 1200 and 316. During this third step, the connecting base 314 for an element, such as the sight glass 108, is formed if necessary.

Figure 39:
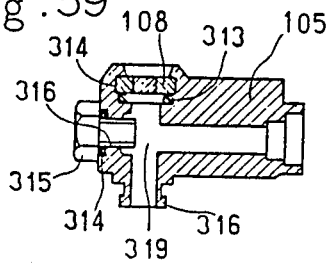
FIG. 39 is a view of the corresponding to FIG. 38 but having accessory elements added thereto.

FIG. 39 shows the fourth step for assembling the elements 315 and 108. The sight glass 108 is fixed by calking. The O-ring 313 is provided between the lower surface of the sight glass 108 and the block joint 105. The bolt 315 is screwed into the screw hole 321. The O-ring 314 between the bolt 315 and the block joint 105 seals liquid tight therebetween.

Figure 41:
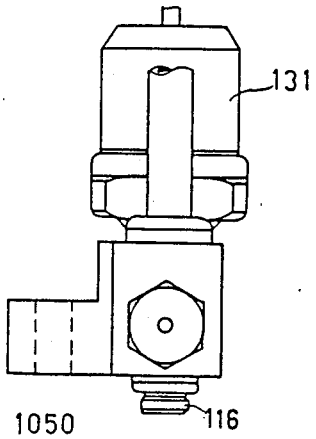
FIG. 41 is a side of the block joint shown in FIG. 40.
Figure 40:
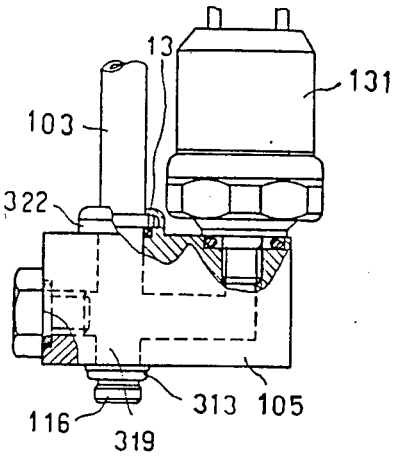
FIG. 40 is a front view, partly in section, of the block joint.

Though the block joint 105 of the above embodiment has the element 108 at the opposite side of the connecting portion 116, the outlet pipe 103 can be assembled at the opposite side of the connecting portion 116 instead of the element 108. As shown in FIGS. 40 and 41, a caulking sleeve 322 for holding the edge of the outlet pipe 103 is formed at the approximately opposite side of the connecting portion 116. The bolt 115 and the pressure switch 131 are fixed onto the block joint 105 at the other portion. It is needless to say that the sleeve 322 does not have to be formed at the absolutely opposite side of the connecting portion 116, but may be formed within the maximum outer surface diameter of the preliminary protruding portion 3160 (FIG. 36) formed by the pressing step.

Figure 43:
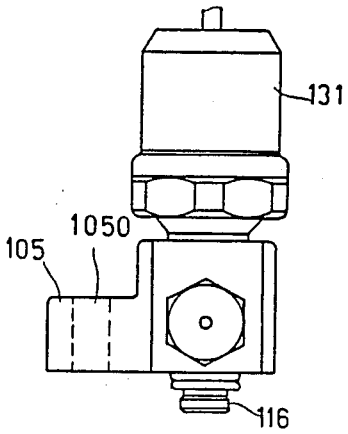
FIG. 43 is a front of the block joint shown in FIG. 42.
Figure 42:
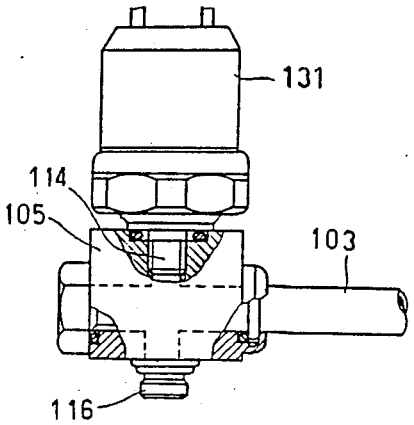
FIG. 42 is a side view of another modification of the block joint.

Any kind of accessory element can be connected on the block joint 105. The pressure switch 131 may be assembled instead of the sight glass 108, as shown in FIGS. 42 and 43. Both elements 108 and 131 may be assembled on the block joint 105, as shown in FIGS. 17 and 18.

The tube 109 of the above embodiments is connected to the connecting portion 116 of the block joint 105 via a part of the top portion 1010, but the tube 109 can be connected with the connecting portion 116 directly, in other words without any part of the top portion 1010.

Though the shapes of the connecting portion 316, sleeve portion 1200, and the holes for connecting the elements 108 and 131 are cylindrical, other shapes such as polygonal may be employed.

Since the block joint 105 of this embodiment has a cylindrical shape such as the caulking sleeve 314 in the preliminary recessed portion 3140 and has the connecting portion 116 in the preliminary protruding portion 3160, and since both the preliminary convexing portion 3140 and the preliminary protruding 3160 are formed by the pressing step simultaneously the production cost of the block joint 105 can be reduced.

Figure 44:
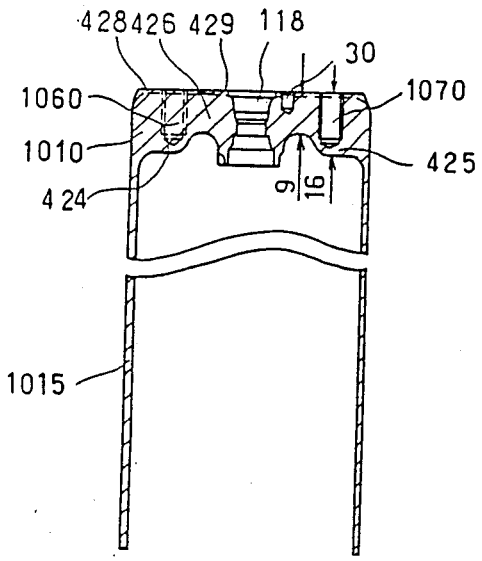
FIG. 44 is a sectional view of another modification of the receiver housing.
Figure 45:
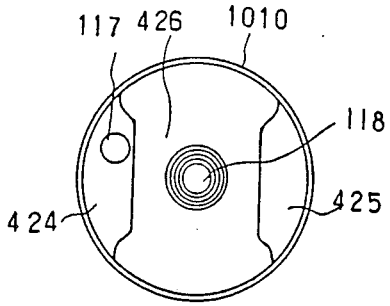
FIG. 45 is a top view of the receiver housing shown in FIG. 44.

The top portion 1010 and the wall portion 1015 shown in FIGS. 44 and 45 are formed integrally. The top portion 1010 has thick portions 424 and 425, the thickness of which is approximately 16 mm, and a thin portion 426 the thickness of which is approximately 9 mm. The screw sockets 1060 and 1070 are formed in the thick portions 424 and 425 so that the block joints 104 and 105 can be fixed firmly thereon. Since the thick portions 424 and 425 are formed in the top portion 1010 symmetrically, the receiver housing 101 can be formed by a forging press effectively. The producting method of the receiver housing 101 is described as follows:

A preliminary cylindrical shape having the wall portion 1015 and the top portion 1010 which has no holes is formed from the material by cold forging. The thick portions 424 and 425 are formed during this step. Since the thick portions 424 and 425 are located symmetrically, the flow of the metal can be attained effectively during this cold forging step, so that it is hard to generate any defect, such as a crack, in the preliminary cylindrical shape.

After that the pilot sockets 427 and 430, the screw sockets 1060 and 1070, and the through holes 117 and 118 are drilled into the top portion 1010.

Since the top portion 1010 and the wall portion 1015 are formed integrally from the same material, the leaking of the coolant therebetween is prevented.

What is claimed is:

1. Receiver means for coolant in a refrigerant circuit comprising:

a receiver housing having a top end portion provided with an inlet through hole, an outlet through hole, a first exterior threaded socket adjacent said inlet hole and a second exterior threaded socket adjacent said outlet hole;

a first block joint mounted exteriorly on said top portion and having a first through hole aligned with said first socket, and an inlet passage therethrough having one end thereof connected to said inlet hole and the other end thereof adapted to have one end of an inlet pipe connected thereto;

first screw means extending through said first through hole into threaded engagement in said first socket to detachably secure said first block joint to said top portion;

a second block joint mounted exteriorly on said top portion and having a second through hole aligned with said second socket, and an outlet passage therethrough having one end thereof connected to said outlet through hole and the other end thereof adapted to have one end of an outlet pipe connected thereto; and second screw means extending through said second through hole into threaded engagement in said second socket to detachably secure said second block joint to said top portion.

2. Receiver means in accordance with claim 1 in which the other end of the passage through at least one of the block joints opens through a surface of the latter opposite to that opposed to the top portion so that the pipe connected to said other end extends generally parallel to said inlet and outlet through holes.

3. Receiver means according to claim 1 including a sight glass mounted to at least one of said blocks to observe coolant in the passage therein.

4. Receiver means according to claim 1 including a pressure switch mounted to at least one of said blocks for detecting the pressure of the coolant in the passage therein.

5. Receiver means according to claim 1 wherein at least one of the block joints is provided with a cylindrical caulking sleeve about the other end of the passage therethrough to be caulked against an annular exterior ring on the one end of the pipe received in said sleeve.

6. Receiver means according to claim 1 including a pipe end connected to the other end of the passage through at least one of the block joints, said end being generally L-shaped.

7. Receiver means according to claim 1 in which the receiver housing has a side wall and a bottom end portion having a peripheral reinforcing flange secured to the inner side of said side wall.

8. Receiver means according to claim 1 in which the receiver housing includes a side wall portion formed integrally with said top portion.

9. Receiver means according to claim 7 in which the bottom end portion is formed by stamping.

10. Receiver means according to claim 7 wherein the bottom portion is fastened to the side wall by welding.

11. Receiver means according to claim 1 wherein at least one of the block joints has a protruding portion at the one end of the passage therethrough connected to the corresponding inlet/outlet through hole and a recessed portion in a side of said one block joint opposite said protrusion.

12. Receiver means according to claim 11 including a sight glass secured in said recessed portion for observing coolant in the passage through said block joint.

13. Receiver means in accordance with claim 11 including a pressure detecting switch secured in said recessed portion for detecting pressure of the coolant in the passage through said block joint.

* * * * *